US011009817B2

(12) United States Patent
Fujiwara et al.

(10) Patent No.: US 11,009,817 B2
(45) Date of Patent: May 18, 2021

(54) PRESSER, FIXING DEVICE, AND IMAGE FORMING APPARATUS

(71) Applicants: Hitoshi Fujiwara, Kanagawa (JP); Hiroshi Kajiyama, Tokyo (JP)

(72) Inventors: Hitoshi Fujiwara, Kanagawa (JP); Hiroshi Kajiyama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/869,737

(22) Filed: May 8, 2020

(65) Prior Publication Data

US 2021/0003947 A1 Jan. 7, 2021

(30) Foreign Application Priority Data

Jul. 3, 2019 (JP) ..... JP2019-124639

(51) Int. Cl.
*G03G 15/20* (2006.01)

(52) U.S. Cl.
CPC ..... *G03G 15/2032* (2013.01); *G03G 15/2039* (2013.01); *G03G 2215/2003* (2013.01)

(58) Field of Classification Search
CPC ..... G03G 15/2032; G03G 15/2035; G03G 2215/2035
See application file for complete search history.

(56) References Cited

U.S. PATENT DOCUMENTS 9,841,710 B1 * 12/2017 Kanai ..... G03G 15/2028
10,599,080 B2 * 3/2020 Tsuji ..... G03G 15/2039
2003/0118356 A1 * 6/2003 Ito ..... G03G 15/2032 399/13
2009/0035033 A1 * 2/2009 Chang ..... G03G 15/206 399/328
2011/0097122 A1 * 4/2011 Okamoto ..... G03G 15/2032 399/329
2011/0176821 A1 7/2011 Hase
2012/0170957 A1 * 7/2012 Lim ..... G03G 15/2064 399/331
2012/0237229 A1 9/2012 Okamoto
2020/0033764 A1 1/2020 Kajiyama et al.

FOREIGN PATENT DOCUMENTS

JP 2008-122744 5/2008
JP 2011-145543 7/2011
JP 2012-194421 10/2012
JP 2014115585 A * 6/2014
JP 2017076091 A * 4/2017

OTHER PUBLICATIONS

U.S. Appl. No. 16/750,066, filed Jan. 23, 2020, Hitoshi Fujiwara.
U.S. Appl. No. 16/811,955, filed Mar. 6, 2020, Yoshiharu Takahashi, et al.

* cited by examiner

*Primary Examiner* — Robert B Beatty
(74) *Attorney, Agent, or Firm* — Oblon, McClelland, Maier & Neustadt, L.L.P.

(57) ABSTRACT

A presser presses a rotator and switches between a pressurization state in which the presser presses the rotator and a depressurization state in which the presser releases the pressurization state. The presser includes a pressure portion that presses the rotator in the pressurization state. The presser further includes a retracted portion that retracts from the pressure portion in a retracting direction in which the retracted portion retracts from the rotator. The retracted portion presses the rotator in the depressurization state.

18 Claims, 4 Drawing Sheets

PRESSER, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-124639, filed on Jul. 3, 2019, in the Japan Patent Office, the entire disclosure of which is hereby incorporated by reference herein.

BACKGROUND

Technical Field

Exemplary aspects of the present disclosure relate to a presser, a fixing device, and an image forming apparatus.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses may include a fixing device that fixes an image on a recording medium such as a sheet. The fixing device includes a presser that presses a pressure roller serving as a first rotator against a fixing belt serving as a second rotator to form a fixing nip between the pressure roller and the fixing belt.

SUMMARY

This specification describes below an improved presser. In one embodiment, the presser presses a rotator and switches between a pressurization state in which the presser presses the rotator and a depressurization state in which the presser releases the pressurization state. The presser includes a pressure portion that presses the rotator in the pressurization state and a retracted portion that retracts from the pressure portion in a retracting direction in which the retracted portion retracts from the rotator. The retracted portion presses the rotator in the depressurization state.

This specification further describes an improved fixing device. In one embodiment, the fixing device includes a first rotator and a second rotator to be pressed by the first rotator to form a fixing nip between the first rotator and the second rotator. A presser presses the first rotator against the second rotator. The presser switches between a pressurization state in which the presser presses the first rotator against the second rotator and a depressurization state in which the presser releases the pressurization state. The presser includes a pressure portion that presses the first rotator in the pressurization state and a retracted portion that retracts from the pressure portion in a retracting direction in which the retracted portion retracts from the first rotator. The retracted portion presses the first rotator in the depressurization state.

This specification further describes an improved image forming apparatus. In one embodiment, the image forming apparatus includes an image bearer that bears an image and the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
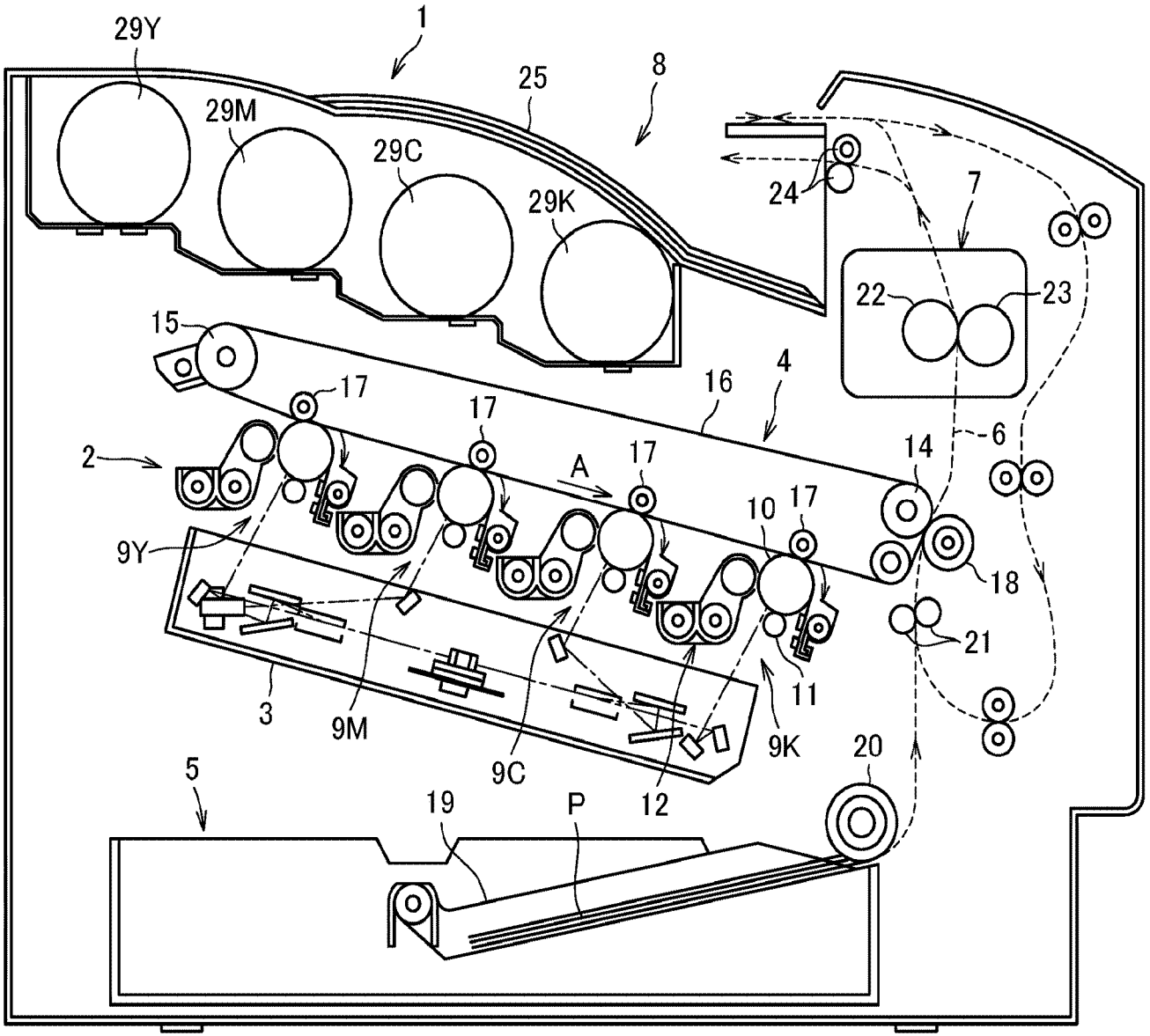
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of embodiments of the present disclosure. In the drawings, identical reference numerals are assigned to identical elements and equivalents and redundant descriptions of the identical elements and the equivalents are summarized or omitted properly.

Referring to FIG. 1, a description is provided of a construction of an image forming apparatus 1 that forms a color toner image on a recording medium.

An image forming device 2 is disposed in a center portion of the image forming apparatus 1. The image forming device 2 includes four process units 9Y, 9M, 9C, and 9K that are removably installed in the image forming device 2. The process units 9Y, 9M, 9C, and 9K have a similar construction except that the process units 9Y, 9M, 9C, and 9K contain developers in different colors, that is, yellow (Y), magenta (M), cyan (C), and black (K), respectively, which correspond to color separation components for a color image.

For example, each of the process units 9Y, 9M, 9C, and 9K includes a photoconductive drum 10, a charging roller 11, and a developing device 12. The photoconductive drum 10 is a drum-shaped rotator serving as an image bearer that bears a toner image formed with toner as a developer on a surface thereof. The charging roller 11 uniformly charges the surface of the photoconductive drum 10. The developing device 12 includes a developing roller that supplies toner onto the surface of the photoconductive drum 10, forming a toner image thereon.

An exposure device 3 is disposed below the process units 9Y, 9M, 9C, and 9K. The exposure device 3 emits a laser beam according to image data.

A transfer device 4 is disposed immediately above the image forming device 2. The transfer device 4 includes a driving roller 14, a driven roller 15, an intermediate transfer belt 16, and primary transfer rollers 17. The intermediate transfer belt 16 is an endless belt stretched taut across the driving roller 14 and the driven roller 15 such that the intermediate transfer belt 16 is rotatable in a rotation direction A. The primary transfer rollers 17 are disposed opposite the photoconductive drums 10 of the process units 9Y, 9M, 9C, and 9K, respectively, via the intermediate transfer belt 16. The primary transfer rollers 17 disposed opposite the photoconductive drums 10, respectively, press against an inner circumferential surface of the intermediate transfer belt 16, bringing an outer circumferential surface of the intermediate transfer belt 16 into contact with the photoconductive drums 10 and forming primary transfer nips between the intermediate transfer belt 16 and the photoconductive drums 10, respectively.

The driving roller 14 drives and rotates the intermediate transfer belt 16. A secondary transfer roller 18 is disposed opposite the driving roller 14 via the intermediate transfer belt 16. The secondary transfer roller 18 presses against the outer circumferential surface of the intermediate transfer belt 16. Thus, a secondary transfer nip is formed between the secondary transfer roller 18 and the intermediate transfer belt 16 contacted by the secondary transfer roller 18.

A sheet feeder 5 is disposed in a lower portion of the image forming apparatus 1. The sheet feeder 5 includes a sheet feeding tray 19 (e.g., a paper tray) and a sheet feeding roller 20. The sheet feeding tray 19 loads a plurality of sheets P serving as recording media. The sheet feeding roller 20 picks up and feeds a sheet P from the sheet feeding tray 19.

A conveyance path 6 conveys the sheet P picked up and conveyed from the sheet feeder 5. A plurality of conveying roller pairs, in addition to a registration roller pair 21, is disposed properly in the conveyance path 6 that leads to a sheet ejector 8 described below.

A fixing device 7 includes a fixing belt 22 that is heated by a heater and a pressure roller 23 that presses against the fixing belt 22.

The sheet ejector 8 is disposed downstream from the conveyance path 6 at a most downstream portion of the image forming apparatus 1 in a sheet conveyance direction. The sheet ejector 8 includes a sheet ejection roller pair 24 and a sheet ejection tray 25. The sheet ejection roller pair 24 ejects the sheet P onto an outside of the image forming apparatus 1. The sheet ejection tray 25 stocks the sheet P ejected onto the outside of the image forming apparatus 1.

Toner bottles 29Y, 29M, 29C, and 29K containing fresh yellow, magenta, cyan, and black toners, respectively, are removably disposed in an upper portion of the image forming apparatus 1. The toner bottles 29Y, 29M, 29C, and 29K supply the fresh yellow, magenta, cyan, and black toners to the developing devices 12 through supplying tubes interposed between the toner bottles 29Y, 29M, 29C, and 29K and the developing devices 12, respectively.

Referring to FIG. 1, a description is provided of a basic image forming operation performed by the image forming apparatus 1 having the construction described above.

As the image forming apparatus 1 starts the image forming operation, an electrostatic latent image is formed on the surface of the photoconductive drum 10 of each of the process units 9Y, 9M, 9C, and 9K. The exposure device 3 exposes the photoconductive drums 10 according to image data. The image data is monochrome image data created by decomposing desired full color image data into yellow, magenta, cyan, and black image data. The drum-shaped developing roller supplies the toner stored in the developing device 12 to the electrostatic latent image formed on the photoconductive drum 10, visualizing the electrostatic latent image as a visible toner image (e.g., an image developed with a developer).

In the transfer device 4, as the driving roller 14 is driven and rotated, the driving roller 14 drives and rotates the intermediate transfer belt 16 in the rotation direction A. Each of the primary transfer rollers 17 is applied with a voltage at a polarity opposite a polarity of charged toner under one of a constant voltage control and a constant current control. Thus, a transfer electric field is created at each of the primary transfer nips. The toner images formed on the photoconductive drums 10, respectively, are transferred onto the intermediate transfer belt 16 successively at the primary transfer nips such that the toner images are superimposed on the intermediate transfer belt 16, thus forming a full color toner image on the intermediate transfer belt 16.

On the other hand, as the image forming operation starts, in the lower portion of the image forming apparatus 1, the sheet feeding roller 20 of the sheet feeder 5 starts being driven and rotated, feeding a sheet P of the plurality of sheets P loaded in the sheet feeding tray 19 to the conveyance path 6. The registration roller pair 21 conveys the sheet P sent to the conveyance path 6 to the secondary transfer nip formed between the secondary transfer roller 18 and the intermediate transfer belt 16 pressed by the driving roller 14 at a time when the full color toner image formed on the intermediate transfer belt 16 reaches the secondary transfer nip. The secondary transfer roller 18 is applied with a transfer voltage having a polarity opposite a polarity of charged toner of the full color toner image formed on the intermediate transfer belt 16, thus creating a transfer electric field at the secondary transfer nip. The transfer electric field formed at the secondary transfer nip transfers the toner images constituting the full color toner image formed on the intermediate transfer belt 16 onto the sheet P collectively.

The sheet P transferred with the full color toner image is conveyed to the fixing device 7 where the fixing belt 22 and the pressure roller 23 fix the full color toner image on the sheet P under heat and pressure. The sheet P bearing the fixed full color toner image is separated from the fixing belt 22. The conveying roller pair conveys the sheet P to the sheet ejector 8 where the sheet ejection roller pair 24 ejects the sheet P onto the sheet ejection tray 25.

The above describes the image forming operation to form the full color toner image on the sheet P. Alternatively, one of the four process units 9Y, 9M, 9C, and 9K may be used to form a monochrome toner image or two or three of the four process units 9Y, 9M, 9C, and 9K may be used to form a bicolor toner image or a tricolor toner image.

Figure 2:
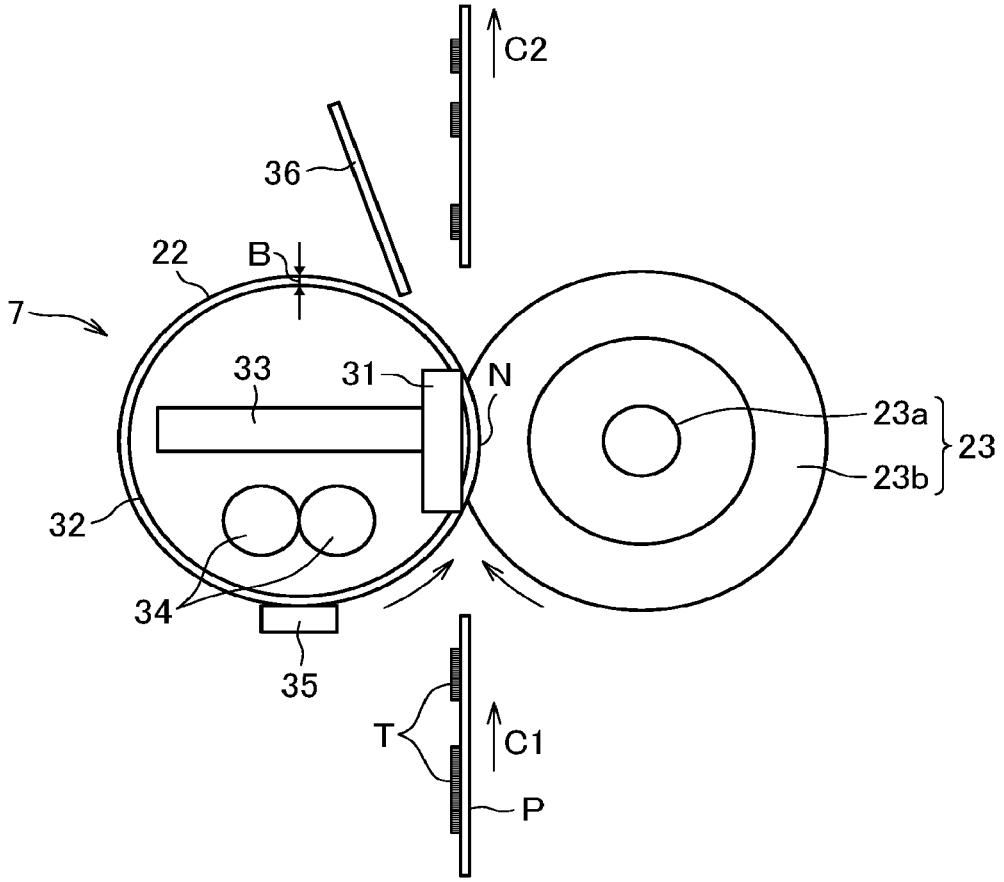
FIG. 2 is a schematic cross-sectional view of a fixing device incorporated in the image forming apparatus depicted in FIG. 1.

Referring to FIG. 2, a description is provided of the construction of the fixing device 7 in more detail.

As illustrated in FIG. 2, the fixing device 7 includes the fixing belt 22 serving as an endless belt or a second rotator, a securing member 31, a thermal conductor 32, a reinforcement 33 serving as a support, a heater 34 serving as a heat source or a heating member, the pressure roller 23 serving as a first rotator, a temperature sensor 35, and a pressure device described below that presses the pressure roller 23. The fixing belt 22 is an endless belt that is thin and has flexibility. The fixing belt 22 rotates counterclockwise in FIG. 2 in a rotation direction indicated with an arrow. The pressure roller 23 contacts or presses against the fixing belt 22 to form a fixing nip N therebetween. The fixing nip N serves as a pressed portion. As a sheet P bearing an unfixed toner image T is conveyed through the fixing nip N, the fixing belt 22 and the pressure roller 23 fix the unfixed toner image T on a surface of the sheet P under heat and pressure.

A detailed description is now given of a construction of the fixing belt 22.

The fixing belt 22 includes a base layer serving as an inner circumferential surface of the fixing belt 22, an elastic layer disposed on the base layer, and a release layer disposed on the elastic layer. The fixing belt 22 has a total thickness of 1 mm or smaller. The base layer of the fixing belt 22 has a layer thickness in a range of from 30 micrometers to 100 micrometers and is made of metal such as nickel and stainless steel or resin such as polyimide. The elastic layer of the fixing belt 22 has a layer thickness in a range of from 100 micrometers to 300 micrometers and is made of rubber such as silicone rubber, silicone rubber foam, and fluororubber. The elastic layer prevents slight surface asperities from being produced on a surface of the fixing belt 22 at the fixing nip N. Accordingly, heat is conducted from the fixing belt 22 to the toner image T on the sheet P evenly, suppressing formation of an orange peel image. The release layer of the fixing belt 22 has a layer thickness in a range of from 10 micrometers to 50 micrometers. The release layer of the fixing belt 22 is made of tetrafluoroethylene-perfluoroalkylvinylether copolymer (PFA), polytetrafluoroethylene (PTFE), polyimide, polyether imide, polyether sulfide (PES), or the like. The release layer facilitates separation and peeling of toner of the toner image T formed on the sheet P from the fixing belt 22.

The fixing belt 22 has a diameter in a range of from 15 mm to 120 mm. According to a first embodiment of the present disclosure, the fixing belt 22 has a diameter of about 30 mm.

A detailed description is now given of a construction of the pressure roller 23.

The pressure roller 23 contacts an outer circumferential surface of the fixing belt 22 at the fixing nip N. The pressure roller 23 has a diameter in a range of from 30 mm to 40 mm. The pressure roller 23 includes a cored bar 23*a* that is hollow and an elastic layer 23*b* disposed on the cored bar 23*a*. The elastic layer 23*b* of the pressure roller 23 is made of silicone rubber foam, silicone rubber, fluororubber, or the like. Optionally, a thin release layer made of PFA, PTFE, or the like may be disposed on a surface of the elastic layer 23*b*.

The pressure roller 23 is solid and cylindrical. A diameter of each lateral end of the pressure roller 23 in an axial direction thereof is greater than a diameter of a center of the pressure roller 23 in the axial direction thereof. For example, a difference in diameter between the center and the lateral end of the pressure roller 23 in the axial direction thereof is in a range of from 0.05 mm to 0.25 mm. The pressure roller 23 is pressed against the fixing belt 22 to form the desired fixing nip N therebetween.

A detailed description is now given of a configuration of the securing member 31.

The securing member 31 (e.g., a nip forming pad) is made of heat resistant resin such as liquid crystal polymer (LCP). An elastic member made of silicone rubber, fluororubber, or the like is interposed between the securing member 31 and the fixing belt 22. Accordingly, the outer circumferential surface of the fixing belt 22 fits slight surface asperities on the surface of the sheet P conveyed through the fixing nip N. Consequently, heat is conducted from the fixing belt 22 to the toner image T on the sheet P evenly, attaining an advantage of preventing formation of an orange peel image. The securing member 31 is disposed within a loop formed by the fixing belt 22. The securing member 31 disposed opposite the inner circumferential surface of the fixing belt 22 supports the fixing belt 22 such that the securing member 31 presses the fixing belt 22 against the pressure roller 23.

The securing member 31 includes a fixing nip side face that faces the pressure roller 23 via the fixing belt 22. The fixing nip side face of the securing member 31 has a concave cross section that corresponds to a curvature of the pressure roller 23. Accordingly, the sheet P is ejected from the fixing nip N such that the sheet P fits the curvature of the pressure roller 23, suppressing a failure that the sheet P adheres to the fixing belt 22 and does not separate from the fixing belt 22 after the sheet P is ejected from the fixing nip N.

As illustrated in FIG. 2, the securing member 31 that forms the fixing nip N is concave in cross section. Alternatively, the securing member 31 that forms the fixing nip N may be planar or may have a plane and a concave portion contiguous to the plane. Since the fixing nip N has an arbitrary shape, if the fixing nip N is substantially parallel to an imaging face of a sheet P, the fixing nip N prevents the sheet P from creasing advantageously. If the fixing nip N is concave in cross section, the sheet P adheres to the fixing belt 22 closely, improving a fixing property of fixing the toner image on the sheet P. Additionally, the curvature of the fixing belt 22 increases at an exit of the fixing nip N, facilitating separation of the sheet P ejected from the fixing nip N from the fixing belt 22.

A detailed description is now given of a configuration of the thermal conductor 32.

The thermal conductor 32 is a pipe having a thickness of 0.2 mm or smaller. The thermal conductor 32 is a thermal conductive body made of metal having a thermal conductivity, such as aluminum, iron, and stainless steel. The thermal conductor 32 has a thickness of 0.2 mm or smaller, improving efficiency in heating the fixing belt 22. The thermal conductor 32 is disposed in proximity to or in contact with the inner circumferential surface of the fixing belt 22 in a circumferential span other than the fixing nip N. The thermal conductor 32 includes a concave portion disposed opposite the inner circumferential surface of the fixing belt 22 at the fixing nip N. The concave portion includes an opening disposed opposite the fixing nip N.

A gap B is provided between the fixing belt 22 and the thermal conductor 32 in the circumferential span other than the fixing nip N at an ambient temperature. The gap B preferably has a length greater than 0 mm and not greater than 1 mm ($0\ \text{mm} < B \leq 1\ \text{mm}$). Accordingly, the area where the fixing belt 22 slides over the thermal conductor 32 does not increase, deaccelerating abrasion of the fixing belt 22. Further, the fixing belt 22 does not separate from the thermal conductor 32 excessively, suppressing decrease in efficiency in heating the fixing belt 22.

Since the thermal conductor 32 is disposed in proximity to the fixing belt 22, the fixing belt 22 having flexibility retains a circular shape to a certain extent, decreasing deformation of the fixing belt 22 and resultant degradation and breakage of the fixing belt 22. In order to decrease a slide resistance between the thermal conductor 32 and the fixing belt 22 that slides over the thermal conductor 32, a slide face of the thermal conductor 32, over which the fixing belt 22 slides, may be made of a material having a decreased coefficient of friction. The inner circumferential surface of the fixing belt 22 may be constructed of a surface layer made of a material containing fluorine.

As illustrated in FIG. 2, the thermal conductor 32 is substantially circular in cross section. Alternatively, the thermal conductor 32 may be polygonal in cross section. If the fixing device 7 includes a separate member that conducts heat from the heater 34 to the fixing belt 22 evenly and stabilizes rotation of the fixing belt 22 when the fixing belt 22 is driven, the fixing device 7 may not incorporate the thermal conductor 32 and may cause the heater 34 to heat the fixing belt 22 directly. In this case, the fixing device 7 eliminates the thermal capacity of the thermal conductor 32, improving temperature increase of the fixing belt 22 and energy saving advantageously.

A detailed description is now given of a configuration of the reinforcement 33.

The reinforcement 33 reinforces and supports the securing member 31 that forms the fixing nip N. The reinforcement 33 is secured inside the loop formed by the fixing belt 22 and disposed opposite the inner circumferential surface of the fixing belt 22.

Both lateral ends of the thermal conductor 32 in a longitudinal direction thereof are secured to and supported by side plates of the fixing device 7, respectively. The heater 34 heats the thermal conductor 32 with radiant heat (e.g., radiant light) so that the thermal conductor 32 heats the fixing belt 22. For example, the heater 34 heats the thermal conductor 32 directly. Thus, the heater 34 heats the fixing belt 22 indirectly through the thermal conductor 32. A controller controls output to the heater 34 based on a detection result provided by the temperature sensor 35 that detects the temperature of the outer circumferential surface of the fixing belt 22. For example, the temperature sensor 35 is a thermistor disposed opposite the outer circumferential surface of the fixing belt 22. Such control of the output to the heater 34 adjusts the temperature, that is, a fixing temperature, of the fixing belt 22 to a desired temperature.

As described above, in the fixing device 7, a part of the fixing belt 22 is not heated locally. The fixing belt 22 is heated by the thermal conductor 32 heated by the heater 34 substantially entirely in a circumferential direction of the fixing belt 22. Accordingly, even if the fixing belt 22 rotates at a high speed, the fixing belt 22 is heated sufficiently, suppressing faulty fixing. FIG. 2 illustrates a halogen heater as one example of the heater 34 serving as a heat source disposed inside the loop formed by the fixing belt 22. However, the heat source is not limited to the halogen heater. For example, the fixing device 7 may incorporate a heat source employing an induction heating method.

A length of the reinforcement 33 in a longitudinal direction thereof is equivalent to a length of the securing member 31 in a longitudinal direction thereof. Both lateral ends of the reinforcement 33 in the longitudinal direction thereof are secured to and supported by the side plates of the fixing device 7, respectively. The reinforcement 33 presses against the pressure roller 23 via the securing member 31 and the fixing belt 22, suppressing a failure that the securing member 31 is deformed substantially by pressure from the pressure roller 23 at the fixing nip N. In order to achieve the functions described above, the reinforcement 33 is preferably made of metal having an enhanced mechanical strength such as stainless steel and iron.

The heater 34 may be a heat source employing a method for heating the fixing belt 22 with radiant heat, such as a halogen heater. In this case, a part or an entirety of an opposed face of the reinforcement 33, that is disposed opposite the heater 34, is mounted with a thermal insulator or is treated with bright annealed (BA) finish or mirror polishing. Radiant heat conducted from the heater 34 to the reinforcement 33, that is, heat which heats the reinforcement 33, is used to heat the thermal conductor 32, improving efficiency in heating the fixing belt 22 through the thermal conductor 32 further.

A gear meshing with a driving gear of a driver is mounted on the pressure roller 23 to drive and rotate the pressure roller 23 clockwise in a rotation direction indicated with an arrow in FIG. 2. Both lateral ends of the pressure roller 23 in the axial direction thereof are rotatably supported by the side plates of the fixing device 7 via bearings, respectively. Alternatively, a heat source such as a halogen heater may be disposed inside the pressure roller 23. If the elastic layer **23*b* of the pressure roller 23 is made of a sponge material such as silicone rubber foam, the elastic layer 23*b* decreases pressure exerted on the fixing nip N, reducing bending of the securing member 31. Additionally, the elastic layer 23*b* enhances thermal insulation of the pressure roller 23, suppressing conduction of heat from the fixing belt 22 to the pressure roller 23 and improving efficiency in heating the fixing belt 22**.

As illustrated in FIG. 2, the diameter of the fixing belt 22 is equivalent to the diameter of the pressure roller 23. Alternatively, the diameter of the fixing belt 22 may be smaller than the diameter of the pressure roller 23. In this case, the curvature of the fixing belt 22 is greater than the curvature of the pressure roller 23 at the fixing nip N, facilitating separation of the sheet P ejected from the fixing nip N from the fixing belt 22. Alternatively, the diameter of the fixing belt 22 may be greater than the diameter of the pressure roller 23. In any case, regardless of a relation between the diameter of the fixing belt 22 and the diameter of the pressure roller 23, pressure is not exerted from the pressure roller 23 to the thermal conductor 32.

With the above-described construction of the fixing device 7, as the sheet P is conveyed through the fixing nip N between the fixing belt 22, that is heated by the heater 34 through the thermal conductor 32, and the pressure roller 23 in a direction C1, the fixing belt 22 and the pressure roller 23 fix the toner image T on the surface of the sheet P under heat and pressure. A separator 36 separates the sheet P bearing the fixed toner image T from the outer circumferential surface of the fixing belt 22. The sheet P is conveyed downstream in a direction C2.

A description is provided of a construction of a comparative fixing device.

The comparative fixing device includes a pressure lever that presses a pressure roller against a fixing roller to form a fixing nip between the pressure roller and the fixing roller. A cam contacts a cam side of the pressure lever, that is opposite a pressure roller side of the pressure lever. As the cam pivots, the pressure lever moves. Accordingly, the pressure lever changes pressurization with respect to the pressure roller, switching between a pressurization state in which the pressure roller presses against the fixing roller and a depressurization state in which the pressure roller does not press against the fixing roller.

In order to switch to the depressurization state, the pressure lever moves the pressure roller in a direction in which the pressure roller separates from the fixing roller. However, as a motion amount with which the pressure roller moves increases, a motion space in which the pressure lever moves increases, upsizing a pressure device including the pressure lever, the pressure roller, and the fixing roller.

Figure 3:
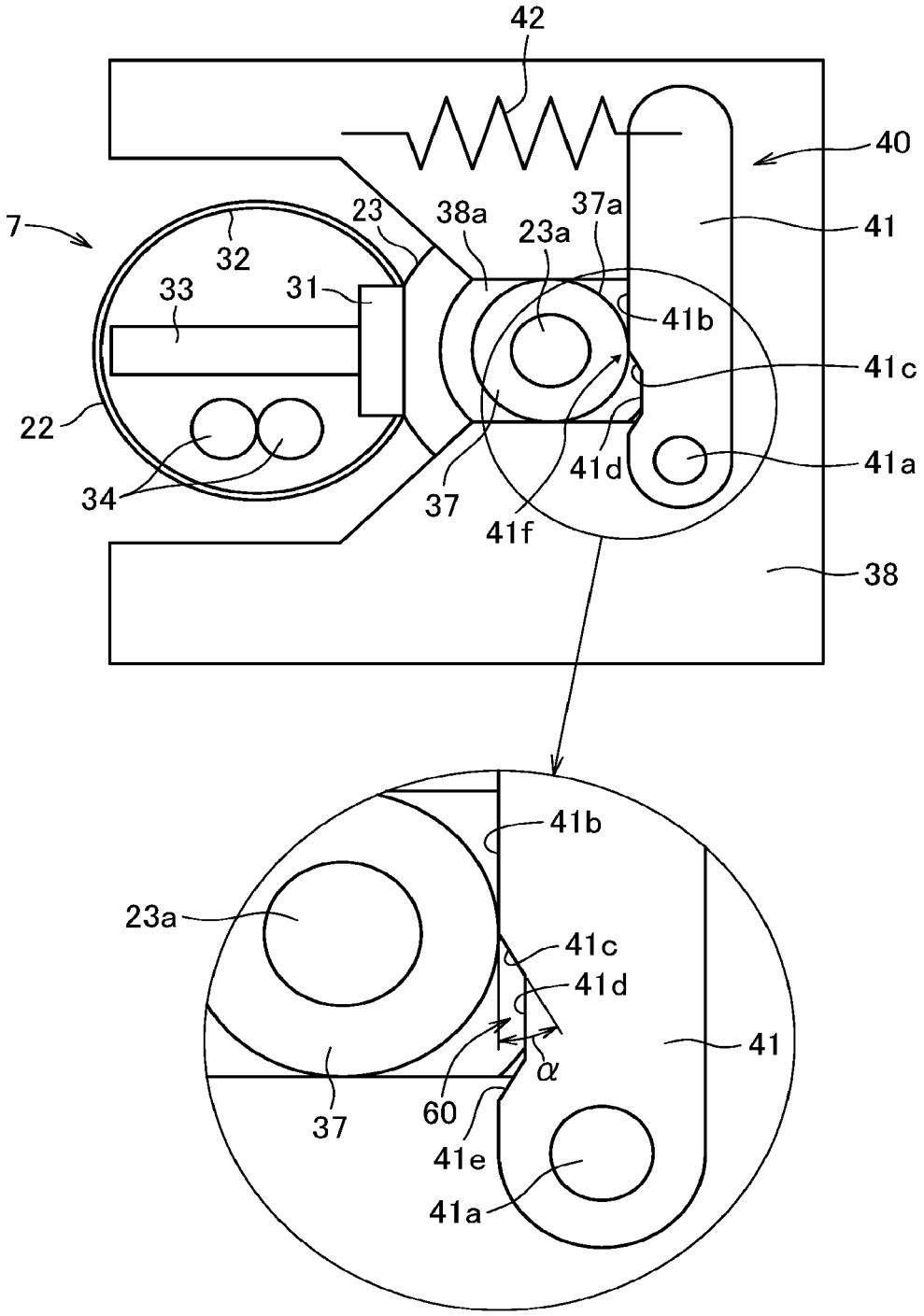
FIG. 3 is a schematic diagram of the fixing device depicted in FIG. 2, illustrating a presser incorporated therein in a pressurization state.

To address this circumstance, as illustrated in FIG. 3, the fixing device 7 having the construction described above includes a pressure device 40 that presses the pressure roller 23 against the fixing belt 22 to form the fixing nip N therebetween. The following describes a construction of the pressure device 40.

FIG. 3 is a diagram of the fixing device 7, illustrating one lateral end of the pressure roller 23 in the axial direction thereof. As illustrated in FIG. 3, a bearing 37 serving as a pressed member is mounted on an outer circumferential surface of the cored bar 23*a* of the pressure roller 23 at each lateral end of the pressure roller 23 in the axial direction thereof. The bearing 37 is fitted into a restricting hole 38*a* of a side plate 38. Thus, the side plate 38 supports the pressure roller 23 through the bearing 37 such that the pressure roller 23 is rotatable in the rotation direction indicated with the arrow in FIG. 2.

The restricting hole 38*a* extends in a horizontal direction in FIG. 3. The side plate 38 rotatably supports the pressure roller 23 such that the pressure roller 23 is also movable in a contact-separation direction in which the pressure roller 23 comes into contact with and separates from the fixing belt 22. In other words, the restricting hole 38*a* restricts a moving direction of the pressure roller 23 to the horizontal direction in FIG. 3.

As illustrated in FIG. 3, the pressure device 40 includes a pressure lever 41 serving as a presser and a pressure spring 42 serving as a biasing member.

The pressure lever 41 is an elongated member elongated to contact the bearing 37 and press against the pressure roller 23 via the bearing 37. The pressure lever 41 includes a pressing portion 41*f* that contacts the bearing 37 and presses against the pressure roller 23 via the bearing 37.

A shaft 41*a* disposed at one end portion of the pressure lever 41 in a longitudinal direction thereof is supported by the side plate 38. The pressure lever 41 is pivotable about the shaft 41*a* with respect to the side plate 38. Another end portion of the pressure lever 41 in the longitudinal direction thereof is coupled with the pressure spring 42. One end of the pressure spring 42 is coupled with the pressure lever 41. Another end of the pressure spring 42 is anchored to the side plate 38.

The pressing portion 41*f* that contacts the bearing 37 is disposed on a pressure roller side face of the pressure lever 41, that faces the pressure roller 23. For example, the pressure lever 41 includes a plane 41*b* serving as a pressure portion, a slope 41*c* serving as a retracted portion, and a bottom face 41*d*. The plane 41*b*, the slope 41*c*, and the bottom face 41*d* are contiguous in a direction directed from a pressure spring side end of the pressure lever 41, which is coupled with the pressure spring 42, to a shaft side end of the pressure lever 41, which is provided with the shaft 41*a*. As illustrated in FIG. 3, the plane 41*b* of the pressure lever 41 contacts the bearing 37. The plane 41*b* and the bottom face 41*d* extend in a direction substantially parallel to the longitudinal direction of the pressure lever 41, that is, a vertical direction in FIG. 3. The slope 41*c* is tilted relative to the longitudinal direction of the pressure lever 41 on a plane (e.g., a cross section) perpendicular to the axial direction of the pressure roller 23, that is, a plane of paper illustrating FIG. 3. The slope 41*c* is tilted in a separating direction separating from the pressure roller 23 and the bearing 37 farther toward the shaft 41*a*, that is, a rightward direction in FIG. 3. The slope 41*c* serving as a first slope, the bottom face 41*d*, and a slope 41*e* serving as a second slope construct a recess 60 recessed in a retracting direction retracted from the pressure roller 23 and the bearing 37.

A compressive force of the pressure spring 42 biases the pressure lever 41 leftward in FIG. 3. A biasing force of the pressure spring 42 pivots the pressure lever 41 about the shaft 41*a* counterclockwise in FIG. 3, bringing the pressure lever 41 into contact with the bearing 37 and pressing the pressure lever 41 against the pressure roller 23 via the bearing 37.

As the bearing 37 is fitted into the restricting hole 38*a* of the side plate 38, the restricting hole 38*a* restricts the moving direction of the pressure roller 23 to an extending direction of the restricting hole 38*a*, that is, the contact-separation direction of the pressure roller 23 with respect to the fixing belt 22. Accordingly, in a pressurization state in which the pressure lever 41 presses the pressure roller 23, a force that moves the pressure roller 23 toward the fixing belt 22 leftward in FIG. 3 presses the pressure roller 23 against the fixing belt 22. For example, the pressure roller 23 is positioned at a position where pressure exerted to the pressure roller 23 from the pressure lever 41 is balanced with a repulsive force generated as the pressure roller 23 presses against the fixing belt 22.

FIG. 3 illustrates the pressurization state in which the pressure lever 41 presses against the pressure roller 23 via the bearing 37, pressing the pressure roller 23 against the fixing belt 22. In the pressurization state, the plane 41*b* of the pressure lever 41 contacts the bearing 37.

Figure 4:
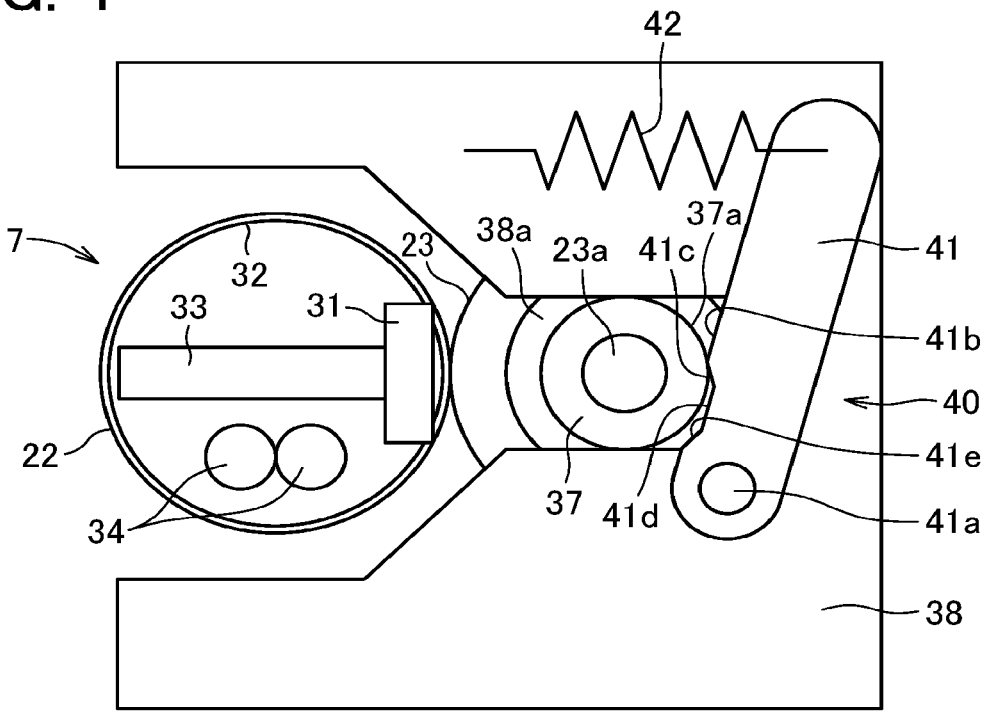
FIG. 4 is a schematic diagram of the fixing device depicted in FIG. 2, illustrating the presser incorporated therein in a depressurization state.

As illustrated in FIG. 4, the pressure lever 41 pivots clockwise, releasing a pressing force that presses the pressure roller 23 against the fixing belt 22. Accordingly, a resilience of the pressure roller 23 moves the pressure roller 23 rightward in FIG. 4, moving the bearing 37 to a position where the bearing 37 contacts the pressure lever 41. Consequently, the pressurization state in which the pressure roller 23 presses against the fixing belt 22 is canceled into a depressurization state. In the depressurization state, the slope 41*c* of the pressure lever 41 contacts the bearing 37. For example, if the sheet P is jammed at the fixing nip N, the sheet P is removed in the depressurization state. As methods for pivoting the pressure lever 41 clockwise in FIG. 4, proper methods are employed. For example, the pressure spring 42 is displaced to decrease the biasing force thereof. A driver presses the pressure lever 41 in a direction opposite a biasing direction in which the pressure spring 42 exerts the biasing force to the pressure lever 41.

When the pressure lever 41 transits from the pressurization state depicted in FIG. 3 to the depressurization state depicted in FIG. 4, a contact face of the pressure lever 41, that contacts the bearing 37, changes from the plane 41*b* to the slope 41*c*. For example, the pressure lever 41 pivots about the shaft 41*a* clockwise in FIG. 3. Contrarily, the bearing 37 and the pressure roller 23 move in parallel rightward in FIGS. 3 and 4. As the bearing 37 and the pressure roller 23 move, a contact part of the pressure lever 41, that contacts the bearing 37, changes in the pressure lever 41 toward the shaft 41*a*, from the plane 41*b* to the slope 41*c*.

As illustrated in FIG. 3, the slope 41*c* contiguous to the plane 41*b* retracts the contact face of the pressure lever 41, which contacts the bearing 37. That is, a part of the contact face of the pressure lever 41, that is interposed between the plane 41*b* and the shaft 41*a*, retracts with respect to the bearing 37 and the pressure roller 23. For example, the contact face of the pressure lever 41, which contacts the bearing 37, that is, a part of the recess 60, retracts with respect to the bearing 37 as illustrated in a right section in FIG. 3. Accordingly, while the pressure lever 41 transits from the pressurization state to the depressurization state, when the contact part of the pressure lever 41, that contacts the bearing 37, changes from the plane 41*b* to the slope 41*c*, the pressure roller 23 moves rightward in FIG. 4 for a retracting amount defined by the recess 60. Compared to a comparative construction of a comparative fixing device, that is different from the construction of the fixing device 7, in which a pressure lever includes a planar contact face that contacts a bearing of a pressure roller, the pressure roller 23 of the fixing device 7 retracts with respect to the fixing belt 22 in a retracting amount greater than a retracting amount of the pressure roller of the comparative fixing device. Thus, the pressure lever 41 pivots clockwise in FIGS. 3 and 4 in a decreased pivot amount to switch from the pressurization state to the depressurization state so as to move the pressure roller 23.

Since the pressure lever 41 pivots in the decreased pivot amount, the pressure lever 41 moves in a decreased motion space, downsizing the pressure device 40 and the fixing device 7. Additionally, the pressure lever 41 pivots with a decreased pivoting force, facilitating work of a user who removes the jammed sheet P from the fixing nip N, for example.

As illustrated in FIG. 3, the bearing 37 includes an outer circumferential surface 37*a* (e.g., a part of an outer circumferential surface of the bearing 37, that faces the pressure lever 41) serving as a pressed portion that is pressed by the pressure lever 41. The outer circumferential surface 37*a* is curved. Since the outer circumferential surface 37*a* of the bearing 37, that contacts the pressure lever 41, is curved, the pressure lever 41 switches between the pressurization state and the depressurization state smoothly. As the pressure lever 41 switches between the pressurization state and the depressurization state, even if an angle with which the pressure lever 41 contacts the bearing 37 changes or the contact face of the pressure lever 41, that contacts the bearing 37, changes from the plane 41*b* to the slope 41*c*, the contact part of the pressure lever 41, that contacts the bearing 37, changes smoothly. For example, if the pressure lever 41 transits from the depressurization state to the pressurization state, while the pressure lever 41 presses the bearing 37 leftward in FIG. 3, the contact part of the pressure lever 41, that contacts the bearing 37, changes. To address this circumstance, the above-described construction of the pressure device 40 causes the pressure lever 41 to transit to the pressurization state smoothly.

As illustrated in an enlarged view in FIG. 3, on the plane perpendicular to the axial direction of the pressure roller 23, that is, the plane of paper illustrating FIG. 3, an angle defined by the slope 41*c* with respect to an extending direction in which the plane 41*b* extends is an angle $\alpha$, that is, an acute angle. As the angle $\alpha$ decreases, the slope 41*c* is gentler, facilitating smooth switching between the pressurization state and the depressurization state. In view of smooth switching between the pressurization state and the depressurization state, the angle $\alpha$ is preferably 15 degrees or smaller and more preferably 11 degrees. On the other hand, as the angle $\alpha$ increases, a step between the plane 41*b* and the bottom face 41*d* increases, attaining a motion amount with which the pressure roller 23 moves in a separating direction in which the pressure roller 23 separates from the fixing belt 22. According to this embodiment, in view of balancing between smooth switching and the motion amount, the angle $\alpha$ is 30 degrees as one example.

According to this embodiment, since the angle $\alpha$ is 30 degrees as described above, a curvature of a hypothetical circle abutting on the slope 41*c* and the bottom face 41*d* is smaller than a curvature of the outer circumferential surface 37*a*, serving as a pressed portion, of the bearing 37. Accordingly, the bearing 37 enters the recess 60 disposed in the pressure lever 41 smoothly so that the outer circumferential surface 37*a* of the bearing 37 comes into contact with the slope 41*c* or the bottom face 41*d* properly. Alternatively, a part or an entirety of the recess 60 may construct a curved portion. For example, the curved portion may adjoin the plane 41*b* and the bottom face 41*d* to couple the plane 41*b* with the bottom face 41*d*.

Figure 5:
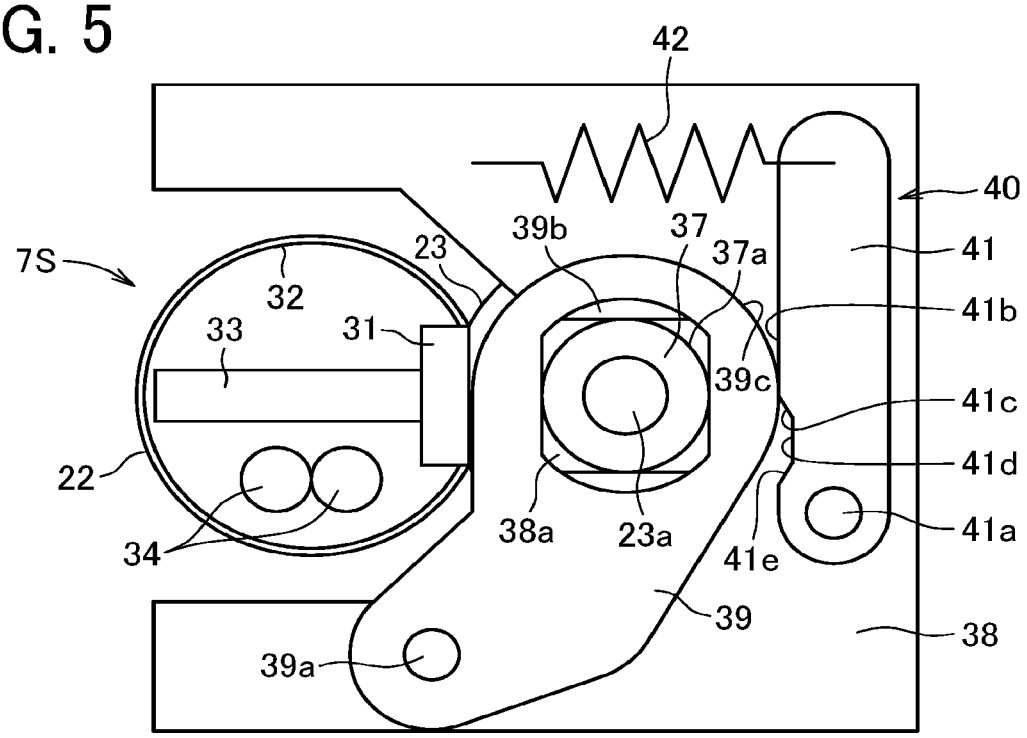
FIG. 5 is a schematic diagram of a fixing device installable in the image forming apparatus depicted in FIG. 1 as a variation of the fixing device depicted in FIG. 3.

A component that contacts the pressure lever 41 may be provided separately. For example, as illustrated in FIG. 5, a fixing device 7S includes a bearing holder 39 that holds the bearing 37 and serves as a pressed member. The pressure lever 41 contacts the bearing holder 39. The following describes an embodiment of the fixing device 7S incorporating the bearing holder 39. A description of a construction of the fixing device 7S, that is equivalent to the above-described construction of the fixing device 7, is omitted properly.

The bearing holder 39 is supported by a shaft 39*a* and provided with an engaging hole 39*b*. The shaft 39*a* is secured to the side plate 38. The bearing holder 39 is pivotable about the shaft 39*a* with respect to the side plate 38. The bearing 37 is inserted into the engaging hole 39*b* of the bearing holder 39. The engaging hole 39*b* engages the outer circumferential surface 37*a* of the bearing 37. The bearing holder 39 includes an outer circumferential surface 39*c*. A contact part of the outer circumferential surface 39*c*, that faces the pressure lever 41, serves as a pressed portion that is contacted and pressed by the pressure lever 41. The outer circumferential surface 39*c* is curved.

FIG. 5 illustrates the pressurization state in which the bearing holder 39 contacts the plane 41*b* of the pressure lever 41. In the depressurization state, the bearing holder 39 contacts the slope 41*c* of the pressure lever 41.

When the pressure lever 41 transits to the depressurization state, like the embodiments described above, as the pressure lever 41 pivots clockwise in FIG. 5, the pressure roller 23 moves rightward, releasing pressing of the pressure roller 23 against the fixing belt 22. As the pressure roller 23 moves, the bearing holder 39 pivots about the shaft 39*a* clockwise in FIG. 5.

When the pressure lever 41 transits from the pressurization state to the depressurization state or from the depressurization state to the pressurization state, as the bearing holder 39 and the pressure lever 41 pivot, respectively, a contact part of the pressure lever 41, that contacts the bearing holder 39, changes. For example, when the pressure lever 41 transits from the pressurization state to the depressurization state, while a contact part of the bearing holder 39, that contacts the pressure lever 41, changes, the contact part of the pressure lever 41, that contacts the bearing holder 39, changes toward the shaft 41*a*, from the plane 41*b* to the slope 41*c*. Accordingly, like the embodiments described above, the pressure lever 41 pivots clockwise in FIG. 5 in a decreased pivot amount to switch from the pressurization state to the depressurization state so as to move the pressure roller 23, thus downsizing the pressure device 40 and the fixing device 7S.

The above describes the embodiments of the present disclosure. However, the technology of the present disclosure is not limited to the embodiments described above and is modified within the scope of the present disclosure.

The image forming apparatus 1 according to the embodiments of the present disclosure is not limited to a color image forming apparatus depicted in FIG. 1 that forms a color toner image. Alternatively, the image forming apparatus 1 may be a monochrome image forming apparatus that forms a monochrome toner image, a copier, a printer, a facsimile machine, a multifunction peripheral (MFP) having at least two of copying, printing, facsimile, scanning, and plotter functions, or the like.

The recording media include, in addition to plain paper as a sheet P, thick paper, a postcard, an envelope, thin paper, coated paper, art paper, tracing paper, an overhead projector (OHP) transparency, plastic film, prepreg, and copper foil.

The embodiments described above encompass a configuration in which a presser (e.g., the pressure lever 41) contacts and presses a first rotator (e.g., the pressure roller 23) directly. Additionally, the embodiments described above encompass a configuration in which the presser contacts and presses the first rotator indirectly via other component, that is, a pressed member. The configuration in which the presser presses the first rotator indirectly via the pressed member encompasses a configuration in which the pressed member is interposed between the first rotator and the presser to transmit pressure from the presser to the first rotator through the pressed member.

According to the embodiments described above, in the depressurization state, the slope 41*c* of the pressure lever 41 contacts the bearing 37 or the bearing holder 39. Alternatively, the bottom face 41*d* serving as a retracted portion of the pressure lever 41 may contact the bearing 37 or the bearing holder 39.

A description is provided of advantages of a pressure device (e.g., the pressure device 40).

As illustrated in FIGS. 3, 4, and 5, the pressure device presses a first rotator (e.g., the pressure roller 23) against a second rotator (e.g., the fixing belt 22). The pressure device includes a presser (e.g., the pressure lever 41) that contacts the first rotator or presses the first rotator against the second rotator. The presser changes pressurization to the first rotator, switching between a pressurization state in which the presser presses the first rotator against the second rotator and a depressurization state in which the presser releases the pressurization state. The presser includes a pressing portion (e.g., the pressing portion 41*f*) that contacts or presses the first rotator directly or indirectly. The pressing portion includes a pressure portion (e.g., the plane 41*b*) and a retracted portion (e.g., the slope 41*c*). The pressure portion contacts or presses the first rotator in the pressurization state. The retracted portion retracts from the pressure portion in a retracting direction in which the retracted portion retracts from the first rotator. The retracted portion contacts or presses the first rotator in the depressurization state.

Accordingly, the presser moves in a decreased motion space.

According to the embodiments described above, the fixing belt 22 serves as a second rotator. Alternatively, a fixing roller, a fixing film, a fixing sleeve, or the like may be used as a second rotator. Further, the pressure roller 23 serves as a first rotator. Alternatively, a pressure belt or the like may be used as a first rotator.

According to the embodiments described above, the image forming apparatus 1 is a printer. Alternatively, the image forming apparatus 1 may be a copier, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A presser for pressing a rotator and switching between a pressurization state in which the presser presses the rotator and a depressurization state in which the presser releases the pressurization state, the presser comprising:

a pressure portion configured to press the rotator in the pressurization state;

a retracted portion configured to retract from the pressure portion in a retracting direction in which the retracted portion retracts from the rotator, the retracted portion configured to press the rotator in the depressurization state; and a shaft disposed at an outer side of the rotator in a longitudinal direction of the rotator, the presser being configured to pivot about the shaft, wherein the retracted portion is interposed between the pressure portion and the shaft.

2. The presser according to claim 1, wherein the pressure portion extends in an extending direction perpendicular to an axial direction of the rotator, and wherein the retracted portion includes a slope being contiguous to the pressure portion, the slope extending in a direction that defines an acute angle with respect to the extending direction of the pressure portion.

3. The presser according to claim 1, wherein the presser is configured to pivot to switch between the pressurization state in which the pressure portion presses the rotator and the depressurization state in which the retracted portion presses the rotator.

4. The presser of claim 1, wherein the shaft is disposed at one end portion of the presser in a longitudinal direction of the presser.

5. A fixing device, comprising:

a first rotator;

a second rotator configured to be pressed by the first rotator to form a fixing nip between the first rotator and the second rotator; and a presser configured to press the first rotator against the second rotator, the presser configured to switch between a pressurization state in which the presser presses the first rotator against the second rotator and a depressurization state in which the presser releases the pressurization state, the presser comprising:

a pressure portion configured to press the first rotator in the pressurization state;

a retracted portion configured to retract from the pressure portion in a retracting direction in which the retracted portion retracts from the first rotator, the retracted portion configured to press the first rotator in the depressurization state; and a shaft disposed at an outer side of the rotator in a longitudinal direction of the rotator, the presser being configured to pivot about the shaft, wherein the retracted portion is interposed between the pressure portion and the shaft.

6. The fixing device according to claim 5, wherein the pressure portion extends in an extending direction perpendicular to an axial direction of the first rotator, and wherein the retracted portion includes a slope being contiguous to the pressure portion, the slope extending in a direction that defines an acute angle with respect to the extending direction of the pressure portion.

7. The fixing device according to claim 6, wherein the shaft is disposed at one end portion of the presser in a longitudinal direction of the presser.

8. The fixing device according to claim 7, wherein the presser is configured to pivot to switch between the pressurization state in which the pressure portion presses the rotator and the depressurization state in which the retracted portion presses the rotator.

9. The fixing device according to claim 5, further comprising a heater configured to heat at least one of the first rotator and the second rotator, wherein the first rotator includes a pressure roller and the second rotator includes a fixing belt.

10. The fixing device according to claim 5, further comprising a pressed portion being curved on a cross section perpendicular to an axial direction of the first rotator and configured to be pressed by the presser.

11. The fixing device according to claim 10, wherein the pressure portion includes a plane extending in an extending direction perpendicular the axial direction of the first rotator, wherein the retracted portion includes a slope being contiguous to the plane, and wherein the presser further includes a bottom face being contiguous to the slope and extending substantially parallel to a longitudinal direction of the presser.

12. The fixing device according to claim 11, further comprising a recess including another slope being contiguous to the bottom face, the recess constructed of the slope, the bottom face, and said another slope.

13. The fixing device according to claim 10, further comprising a pressed member interposed between the presser and the first rotator, the pressed member including the pressed portion, the pressed member configured to transmit pressure from the presser to the first rotator.

14. The fixing device according to claim 13, wherein the pressed member includes a bearing configured to bear the first rotator.

15. The fixing device according to claim 13, further comprising a bearing configured to bear the first rotator, wherein the pressed member includes a bearing holder configured to hold the bearing.

16. The fixing device according to claim 15, further comprising a shaft about which the bearing holder is configured to pivot, wherein the bearing holder includes an engaging hole configured to engage the bearing.

17. The fixing device according to claim 13, wherein the pressure portion includes a plane extending in an extending direction perpendicular to the axial direction of the first rotator, wherein the retracted portion includes a slope being contiguous to the plane, wherein the presser further includes a bottom face being contiguous to the slope and extending substantially parallel to a longitudinal direction of the presser, wherein the slope is configured to define an acute angle with respect to the extending direction of the plane, and wherein a curvature of a hypothetical circle abutting on the slope and the bottom face is smaller than a curvature of the pressed portion of the pressed member.

18. An image forming apparatus, comprising:

an image bearer configured to bear an image; and a fixing device configured to fix the image on a recording medium, the fixing device including:

a first rotator;

a second rotator configured to be pressed by the first rotator to form a fixing nip between the first rotator and the second rotator; and a presser configured to press the first rotator against the second rotator, the presser configured to switch between a pressurization state in which the presser presses the first rotator against the second rotator and a depressurization state in which the presser releases the pressurization state, the presser comprising:

a pressure portion configured to press the first rotator in the pressurization state;

a retracted portion figured to retract from the pressure portion in a retracting direction in which the retracted portion retracts from the first rotator, the retracted portion configured to press the first rotator in the depressurization state; and a shaft disposed at an outer side of the rotator in a longitudinal direction of the rotator, the presser being configured to pivot about the shaft, wherein the retracted portion is interposed between the pressure portion and the shaft.

* * * * *